US010906708B2

(12) United States Patent
Chambers et al.

(10) Patent No.: US 10,906,708 B2
(45) Date of Patent: Feb. 2, 2021

(54) SYSTEMS AND METHODS ASSOCIATED WITH A DRINKING CONTAINER WITH A SOLID, INTEGRATED VALVE

(71) Applicants: James Chambers, Austin, TX (US); Anna Carin Cecilia Chambers, Austin, TX (US)

(72) Inventors: James Chambers, Austin, TX (US); Anna Carin Cecilia Chambers, Austin, TX (US)

( * ) Notice: Subject to any disclaimer, the term of this patent is extended or adjusted under 35 U.S.C. 154(b) by 55 days.

(21) Appl. No.: 16/043,948

(22) Filed: Jul. 24, 2018

(65) Prior Publication Data

US 2019/0039788 A1 Feb. 7, 2019

Related U.S. Application Data

(60) Provisional application No. 62/539,698, filed on Aug. 1, 2017.

(51) Int. Cl.

| | |
|---|---|
| ***B65D 41/04*** | (2006.01) |
| ***B65D 43/02*** | (2006.01) |
| ***B65D 47/06*** | (2006.01) |
| ***B65D 51/16*** | (2006.01) |
| ***A47G 19/22*** | (2006.01) |
| ***B65D 47/32*** | (2006.01) |
| ***B65D 47/20*** | (2006.01) |

(52) U.S. Cl.

CPC ..... *B65D 43/0231* (2013.01); *A47G 19/2205* (2013.01); *A47G 19/2272* (2013.01); *B65D 43/0212* (2013.01); *B65D 47/06* (2013.01); *B65D 47/20* (2013.01); *B65D 47/32* (2013.01); *B65D 51/165* (2013.01); *B65D 2543/00046* (2013.01); *B65D 2543/00092* (2013.01); *B65D 2543/00527* (2013.01); *B65D 2543/00537* (2013.01)

(58) Field of Classification Search

CPC ..... B65D 43/0231; B65D 43/0212; B65D 47/06; B65D 47/20; B65D 47/32; B65D 51/165; B65D 2543/00046; B65D 2543/00092; B65D 2543/00527; B65D 2543/00537; A47G 19/2205; A47G 19/2272

USPC ..... 220/303, 288, 711

See application file for complete search history.

(56) References Cited

U.S. PATENT DOCUMENTS

| | | | | |
|---|---|---|---|---|
| 6,959,830 | B1 * | 11/2005 | Kanou | B65D 1/0223 215/40 |
| 2008/0302799 | A1 * | 12/2008 | Moore | B65D 7/04 220/288 |
| 2009/0065518 | A1 * | 3/2009 | Carnevali | B65D 43/0212 220/711 |

* cited by examiner

*Primary Examiner* — Fenn C Mathew
*Assistant Examiner* — Elizabeth J Volz
(74) *Attorney, Agent, or Firm* — Pierson Intellectual Property LLC

(57) ABSTRACT

A drinking container with an integrated valve that uses surface tension to control the flow of fluid.

7 Claims, 9 Drawing Sheets

SYSTEMS AND METHODS ASSOCIATED WITH A DRINKING CONTAINER WITH A SOLID, INTEGRATED VALVE

BACKGROUND INFORMATION

Field of the Disclosure

Examples of the present disclosure are related systems and methods associated with a drinking container with a solid, integrated valve. More specifically, embodiments are directed towards a drinking container with a valve that utilizes surface tension to control fluid flow and an air vent to limit a vacuum within the container.

Background

A water bottle is a container that is used to hold water, liquids, or other beverages for consumption. A water bottle allows an individual to transport and drink a beverage at multiple locations. Water bottles are typically made of plastic, glass, metal, etc. Water bottles are available in different shapes, colors, and sizes.

Conventional water bottles either implement a removable cap, multi-component lids, or moving valve. When using a removable cap, a user may temporarily remove the cap from the top of the water bottle to access the contents of the bottle. However, once the cap is removed, the flow of fluid from within the water bottle cannot be controlled.

When using a water bottle with a multi-component lid or moving valve, the user may interact with the lid or moving valve to access contents of the water bottle. However, multi-component lids or moving valves include many exposed surface areas, crevices, reticular structures, etc. that are hard to access, and which are breeding grounds for bacteria. This can lead to unsanitary conditions inside the bottle that promote bacterial growth, which leads to food poisoning systems.

Accordingly, needs exist for more effective and efficient systems and methods for a drinking container with an integrated valve that uses surface tension to control the flow of fluid.

SUMMARY

Embodiments disclosed herein describe systems and methods for a drinking container with an integrated valve that uses surface tension to control the flow of fluid. Systems may include a container body and a container lid.

The container body may be configured to store liquid, a medium, etc. In embodiments, the container body may be a bottle, cup, etc. The container body may include a closed lower surface and an open upper surface.

The container lid may be configured to be removably coupled to the open upper surface of the container body. The container lid may include a solid-integrated valve, a depression, and an air intake valve.

The solid, integrated valve may be comprised of a first array of micron-sized holes. The first array of micron-sized holes may be configured to control the flow of fluid through the integrated valve through surface tension. The surface tension may limit liquid flowing through the solid, integrated valve even when the system is inverted. The surface tension created on the top surface of the container lid may be overcome by a user creating suction, which may allow the liquid to flow through the integrated valve.

The depression may be a cutout positioned on the top surface of the container lid. The depression may be configured to create a vertical offset between the integrated valve and the air intake valve, wherein the air intake valve is positioned closer to a distal end of the system than the integrated valve.

The air intake valve may include a second array of holes. The air intake valve may be configured to allow air to flow into the container body, such that a vacuum is not created within the container body. This air flow through the air intake valve may assist in alleviating the vacuum created by suction on the integrated valve.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
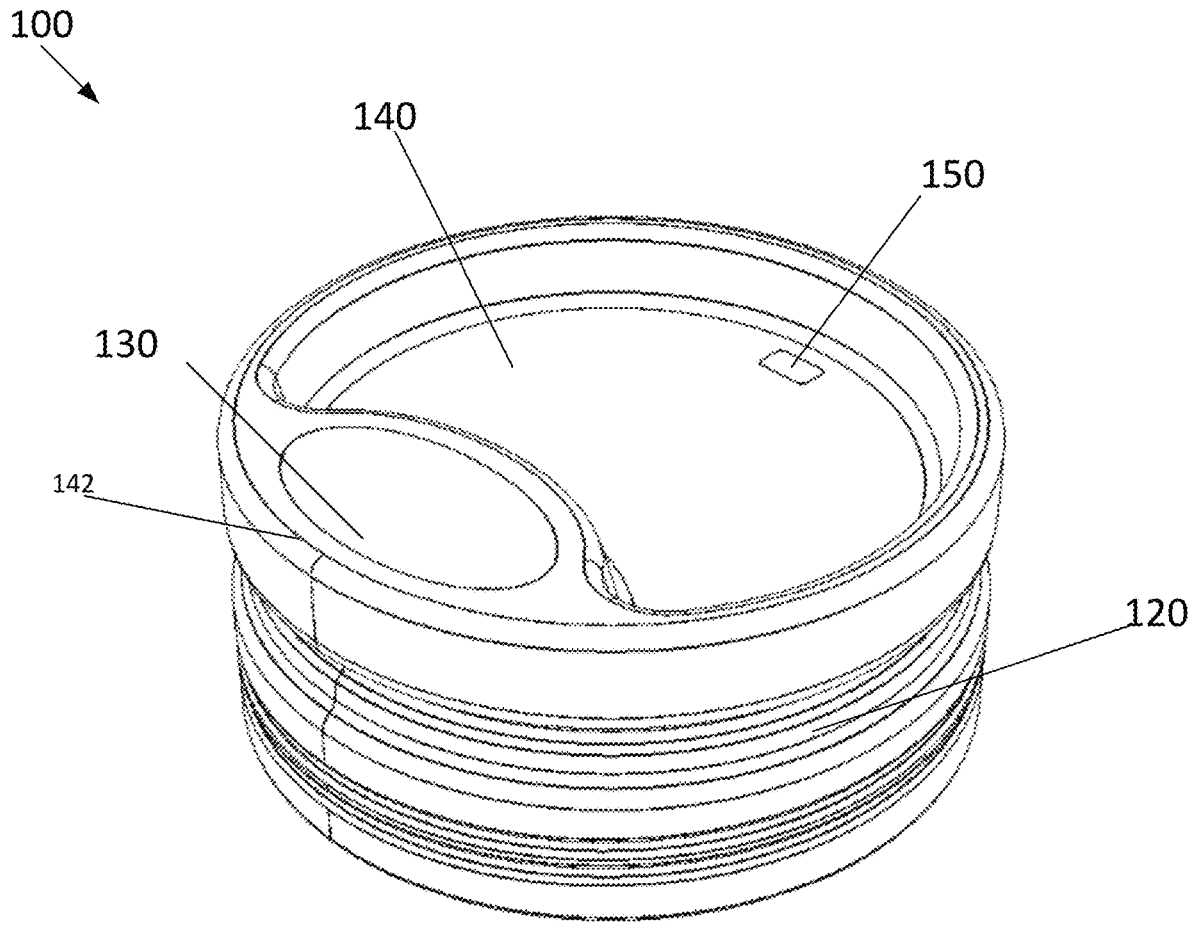
FIG. 1 depicts an embodiment of a system with an integrated valve that uses surface tension to control the flow of fluid.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Figure 2:
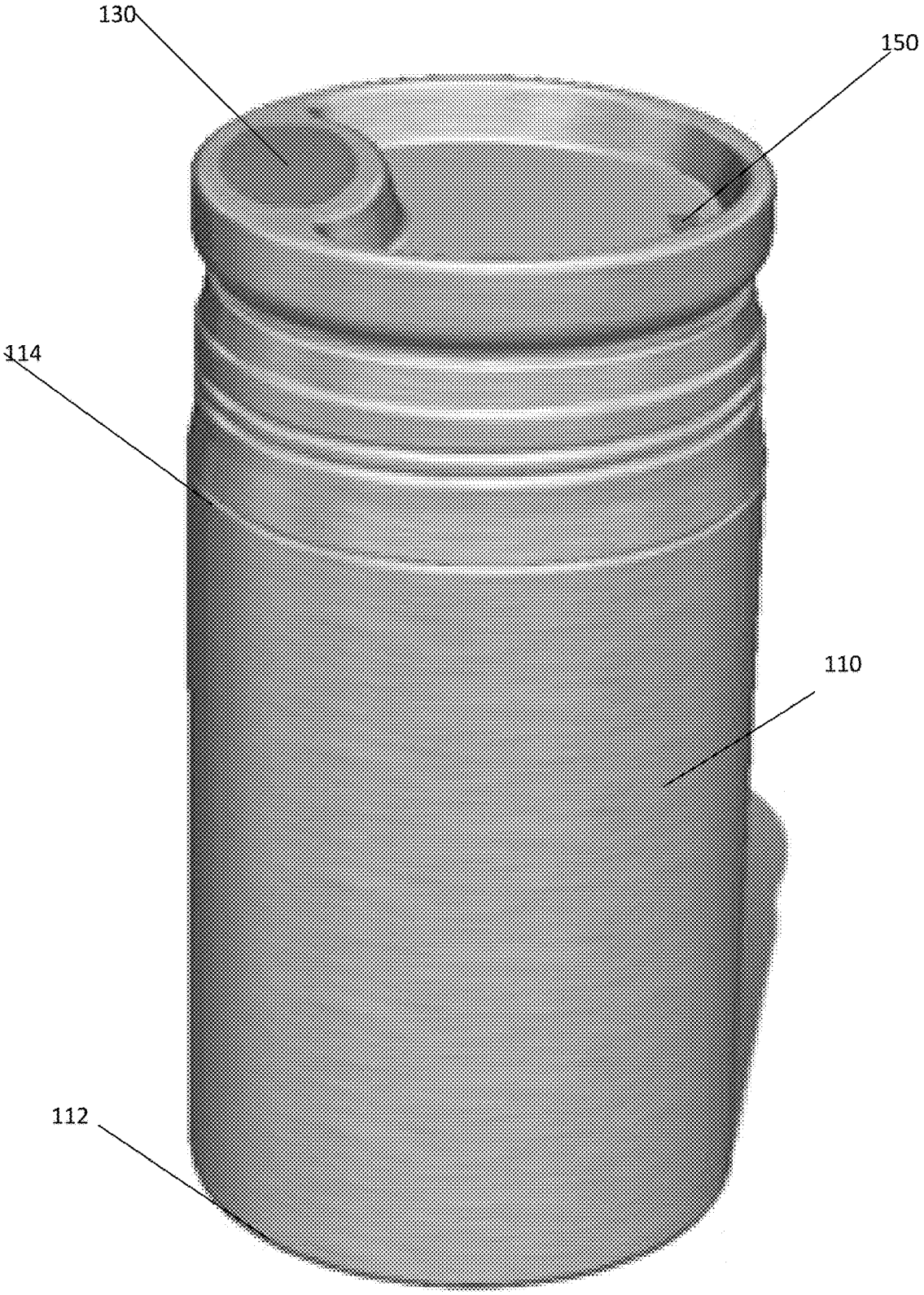
FIG. 2 depicts container lid positioned on container body, according to an embodiment.

FIG. 1 depicts an embodiment of a system 100 with an integrated valve that uses surface tension to control the flow of fluid. System 100 may include container lid 120 that is configured to be positioned on a container body 110, as depicted in FIG. 2.

Container lid 120 may be configured to be removably coupled to the open upper surface of a container body. Container lid 120 may be configured to limit and/or control the flow of fluid from within the hollow chamber to external locations. In embodiments, container lid 120 may be formed of a metal, such as stainless steel, and be a unitary part. Container lid 120 may include integrated valve 130, depression 140, and air intake valve 150.

Integrated valve 130 may be comprised of a first array of micron-sized holes. The first array of micron-sized holes (i.e. $10^{-6}$ meters) may be configured to control the flow of fluid through container body 110 to an outer surface of integrated valve 130 via surface tension. The surface tension created on the outer surface of integrated valve 130 may be overcome by an external force, such as a user creating suction. The user force may be in a direction away from a hollow inner chamber within the container body towards an outer surface of integrated valve 130. The suction may allow liquid within container body 110 to flow through integrated valve 130. In embodiments, the integrated valve 130 may be holes extending through container lid 120 with no additional parts or components. This may reduce the number of surfaces, crevices, etc. where bacteria can form. The holes may be positioned on an upper surface of container lid 120 and extend through a body of container lid 120 to provide a passageway to the hollow chamber within container body 110. Furthermore, the first array may be arranged in a first geometrical shape, such as an oval, having a first surface area. The shape of the first array may correspond to a mouth of a user. However, in other embodiments, the shape of the first array may be different geometrical shapes. The first array may be positioned proximate to an upper circumference 142 of container lid 120. In embodiments, the diameter, depth, length, path, and quantity of the micron-sized holes may be varied independently to control the surface tension created by integrated valve 130 to manipulate the flow of fluids from system 100. Additionally, integrated valve 130 may be comprised of different materials than that of other elements of system 100.

Depression 140 may be a cutout positioned on an upper surface of container lid 120. The depression 140 may be configured to create a vertical offset between integrated valve 130 and air intake valve 150. Depression 140 may be configured to encompass a portion of container lid 120 within a circumference 142 of container lid 120 and adjacent to an inner boundary of integrated valve 130. In embodiments, depression 140 may be arranged in a second geometrical shape having a second surface area, wherein the second geometrical shape is different than the first geometrical shape and the second surface area is greater than the first surface area.

Air intake valve 150 may be comprised of a second array of micron-sized holes, wherein each of the second array of holes extend through a body of container lid 120. The second array of holes may be positioned proximate to the circumference 142 of container lid 120 one hundred eighty degrees from integrated valve 130 with respect to upper surfaces of container lid 120. In embodiments, air intake valve 150 may be positioned closer to the distal end 112 than integrated valve 130. Air intake valve 150 may be configured to allow air to flow into container body 110, such that a vacuum is not created or is alleviated within container body 110 if system 100 is tilted or has been under suction. The air that flows into container body 110 via air intake valve 150 may apply pressure to the liquid in container body 110 towards integrated valve 130. This may assist the created suction force to overcome the surface tension created on the upper surface of integrated valve. The first array may be arranged in a third geometrical shape, such as a rectangle, having a third surface area.

In embodiments, the holes associated with integrated valve 130 and/or air intake valve 150 may be formed by one of several means including lithography and etching with either wet or dry etchants, microstructure alteration and selective etching with either wet of dry etchants, drilling, ion milling, electronic beam milling, etc. In embodiments where the holes are formed directly onto the container lid, the microstructure may be formed via lithography and etching with either wet or dry etchants, microstructure alternation and selective etching with either wet or dry etchants, drilling, ion milling, electron beam milling etc. In embodiments, where the holes are manipulated to control the hydrophobic/hydrophilic properties, the surface may be coated by one or more of several methods including sputter deposition, chemical vapor deposition, atomic layer deposition, electroplating and/or electroless plating. The surface may also be manipulated to control its hydrophobic/hydrophilic properties by functionalizing the surface with assembled monolayers, ion implantation, solid state diffusion, oxidation, hydrogenation, amination, etc.

FIG. 2 depicts container lid 120 positioned on container body 110, according to an embodiment. Container body 110 may be configured to store a medium, such as a liquid, within a hollow chamber. Container body 110 may be formed of metal, such as stainless steel, and be formed of a unitary piece. Container body 110 may include a closed lower surface on a distal end 112 of container body 110, and an open face on a proximal end 114 of container body 110. In embodiments, the proximal end 114 of container body 110 may be configured to be positioned adjacent to and couple with container lid 120. For example, proximal end 114 may include threads or press fittings that are configured to receive corresponding elements on container lid 120.

Figure 3:
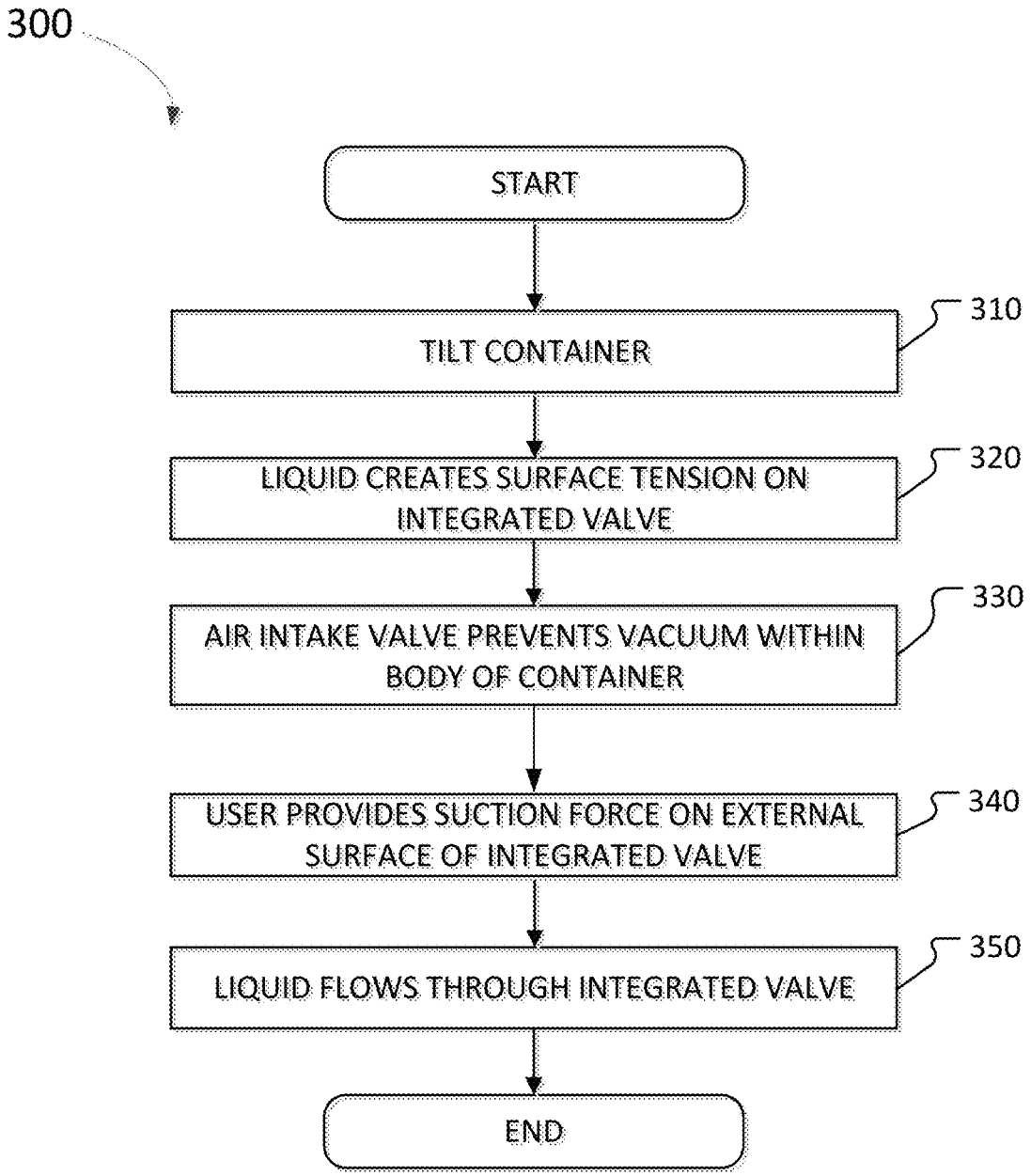
FIG. 3 depicts a method for utilizing a container with a solid, integrated lid to control fluid flow, according to an embodiment.

FIG. 3 depicts a method 300) for utilizing a container with a solid, integrated lid to control fluid flow, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

At operation 310, a container filled with liquid may be tilted downward. This may cause the liquid within the container to move towards a proximal end of the container.

At operation 320, the liquid within the container may create surface tension with a solid, integrated valve. The surface tension may cause the liquid to remain within the container, even while tilted.

At operation 330, air may enter into the container via an air intake valve, such that a vacuum is not created within the container.

At operation 340, an external suction force may be created on the solid, integrated valve, which may be greater than the surface tension force.

At operation 350, due to the external suction force being greater than the surface tension force, the liquid may travel through the solid, integrated valve. Responsive to the suction force no longer being applied, the surface tension may resume controlling the fluid flow out of the container.

Figure 4:
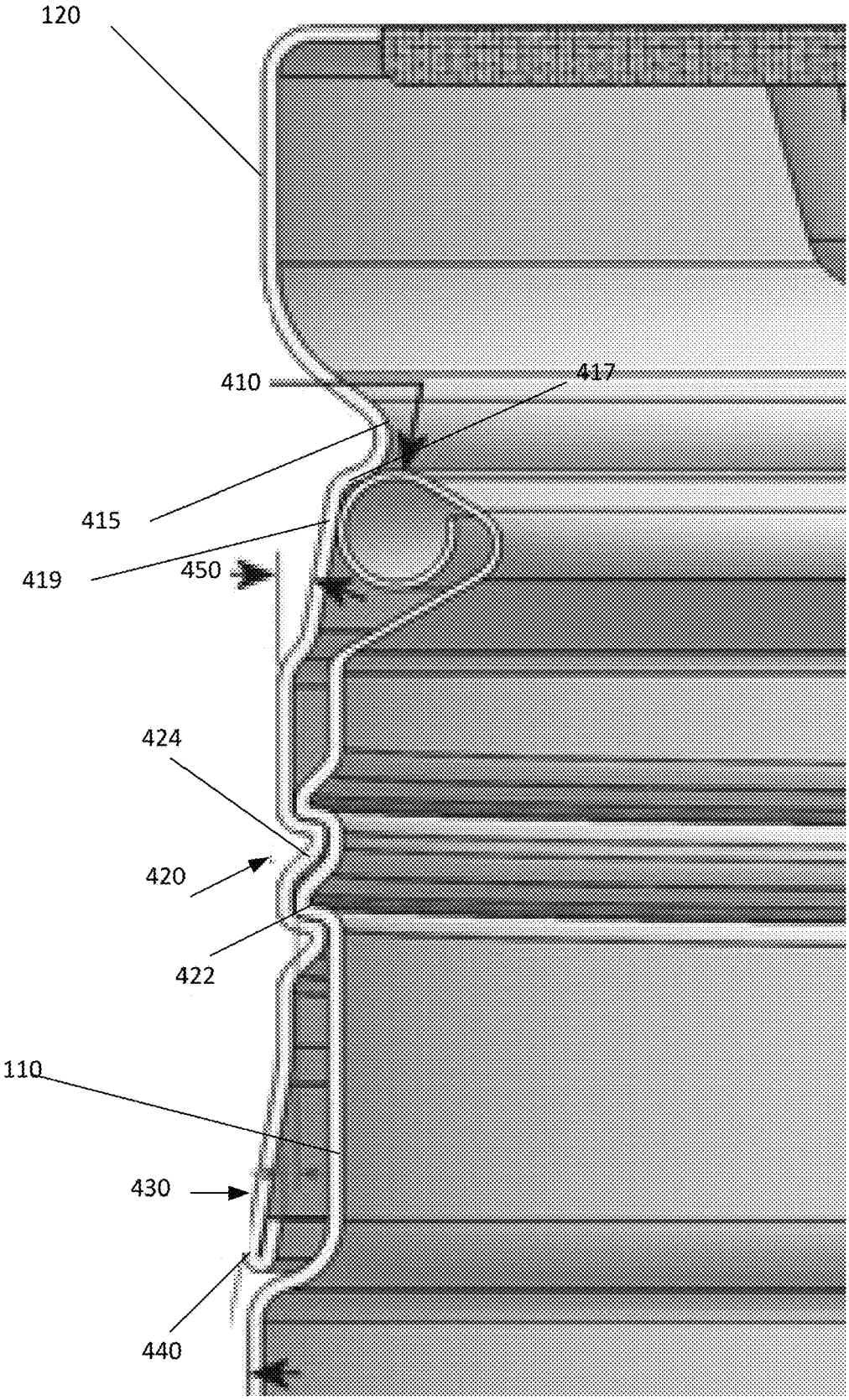
FIG. 4 depicts a cross sectional view of a metal container lid being coupled to a metal container body, according to an embodiment.

FIG. 4 depicts a cross sectional view of a metal container lid 120 being coupled to a metal container body 110, according to an embodiment. Elements depicted in FIG. 4 may be described above. For the sake of brevity, another description of these elements is omitted.

As depicted in FIG. 4, container lid 120 may include groove 415, beveled threads 420, and tab 430.

Groove 415 may be an inward projection on container lid 120. Groove 415 may include an indentation 417 and a sloped sidewall 419. Groove 415 may be configured to apply a downward, compressive force on rolled lip 410 at a first contact point associated with indentation 417 and a second contact point associated with sloped sidewall 419. Responsive to container lid 120 being screwed into container body 110, groove may move closer to distal end 112 of container body 110. This may allow the compressive force applied by groove 415 to increase.

Beveled threads 420 may be positioned between groove 415 and distal end 112. Beveled threads 420 may include an edge 424 that is not perpendicular to that of the central axis of container lid 120. This may increase the surface area of the threads. Beveled threads 420 may be configured to interact with mating threads 422 on container body 110. When beveled threads 420 are tightened around mating threads 422 a seal may be formed between the sidewalls of container lid 120 and container body 110. In embodiments, beveled threads 420 may be configured to rotate approximately seven hundred thirty degrees around mating threads 4220 to secure container lid 120 and container body 110.

Tab 430 may be a flange that flairs 440 outward from the beveled threads 420. This may allow container lid 120 to be positioned on container body 110.

Container body 110 may include a rolled lip 410, and mating threads 422. Rolled lip 410 may be a rounded proximal end of container body 110. Rolled lip 410 may be have less thickness than that of the rest of container body 110. Rolled lip 410 may be configured to apply an expansion force against indentation 417 and a sloped sidewall 419 to assist in decoupling container body 110 and container lid 120. Accordingly, rolled lip 410 may be a spring applying a force against groove 415 in multiple directions.

As described above, mating threads 422 may be threads configured to interact with beveled threads 420. This may allow container lid 120 to be screwed onto container body.

Figure 5:
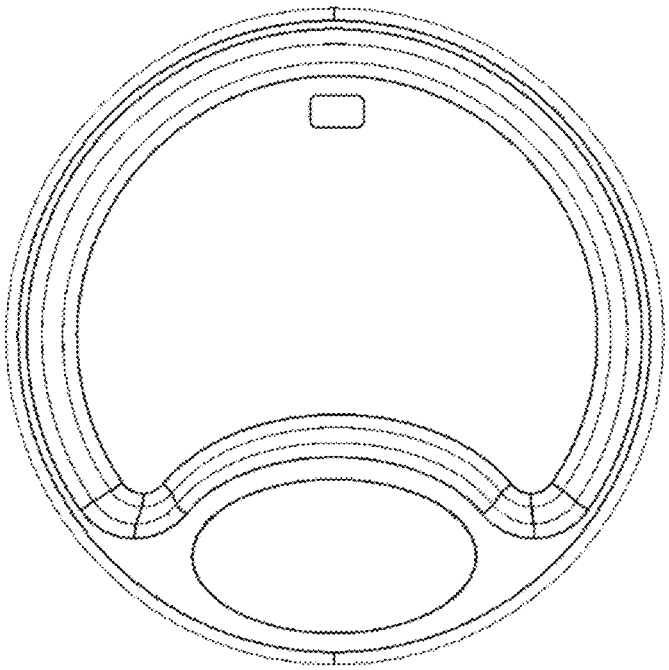
FIG. 5 depicts a top view of container lid 120, according to an embodiment.

FIG. 5 depicts a top view of container lid 120, according to an embodiment.

Figure 6:
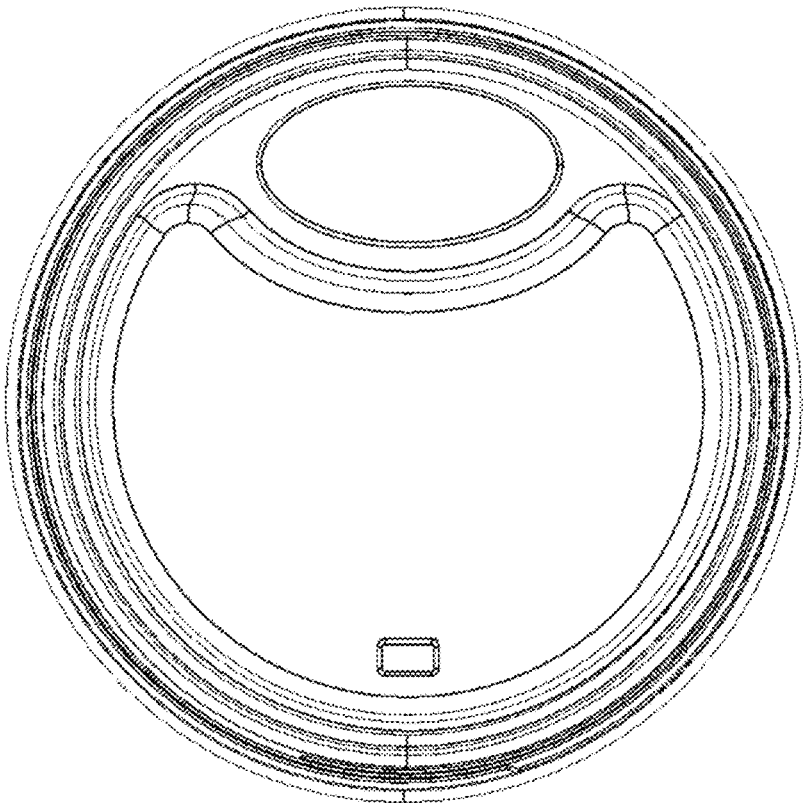
FIG. 6 depicts a bottom view of container lid 120, according to an embodiment.

FIG. 6 depicts a bottom view of container lid 120, according to an embodiment.

Figure 7:
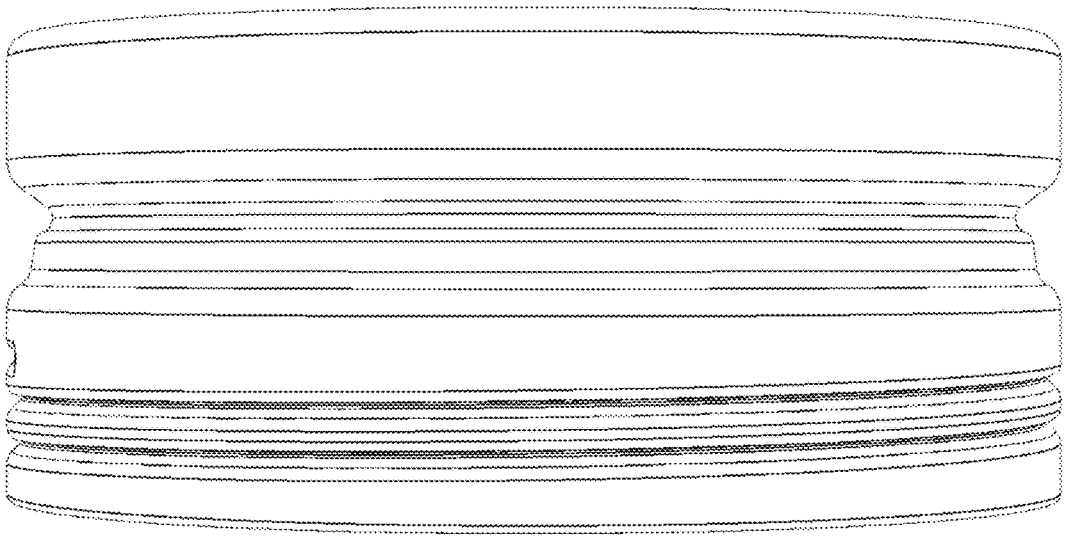
FIG. 7 depicts a first side view of container lid 120, according to an embodiment.

FIG. 7 depicts a first side view of container lid 120, according to an embodiment.

Figure 8:
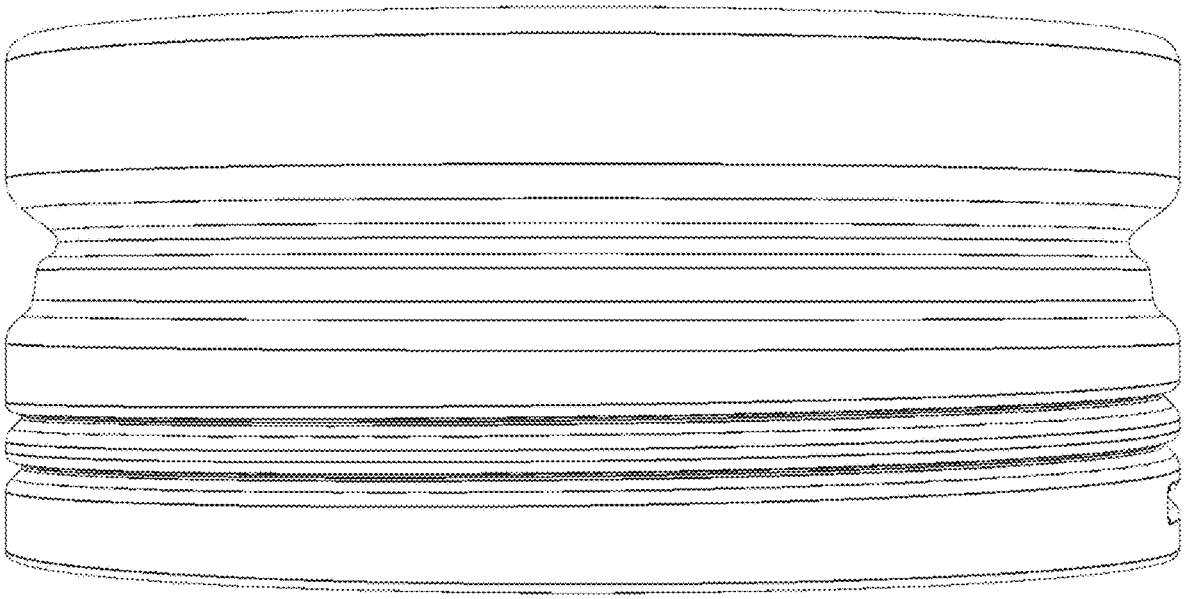
FIG. 8 depicts a second side view of container lid 120, according to an embodiment.

FIG. 8 depicts a second side view of container lid 120, according to an embodiment.

Figure 9:
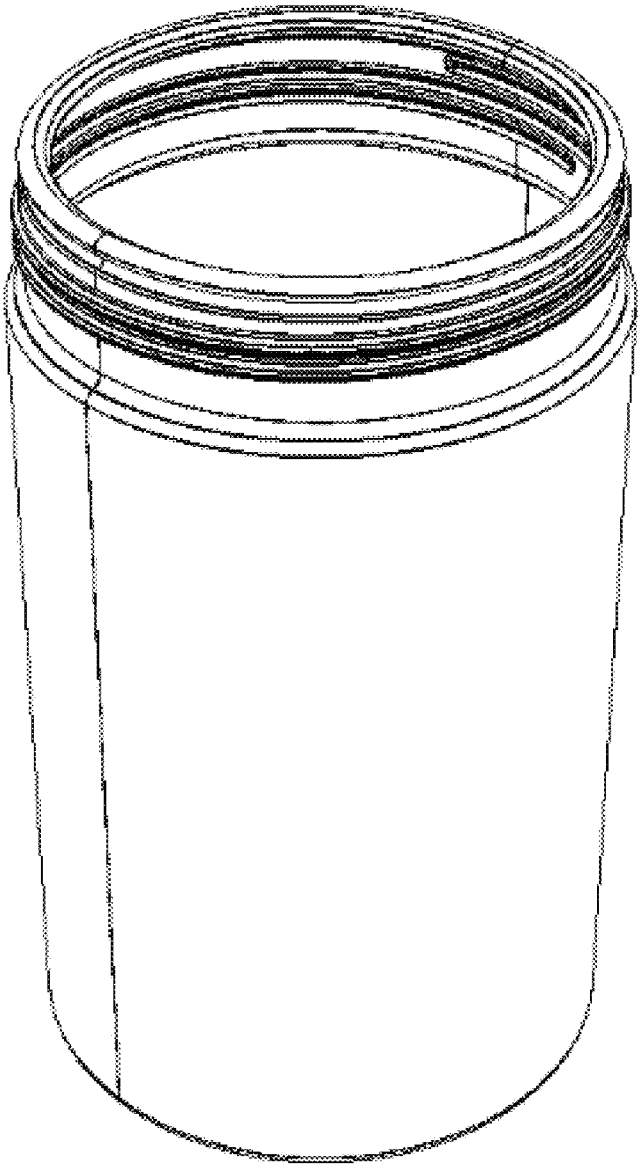
FIG. 9 depicts a perspective view of a container body 110, according to an embodiment.

FIG. 9 depicts a perspective view of a container body 110, according to an embodiment.

Figure 10:
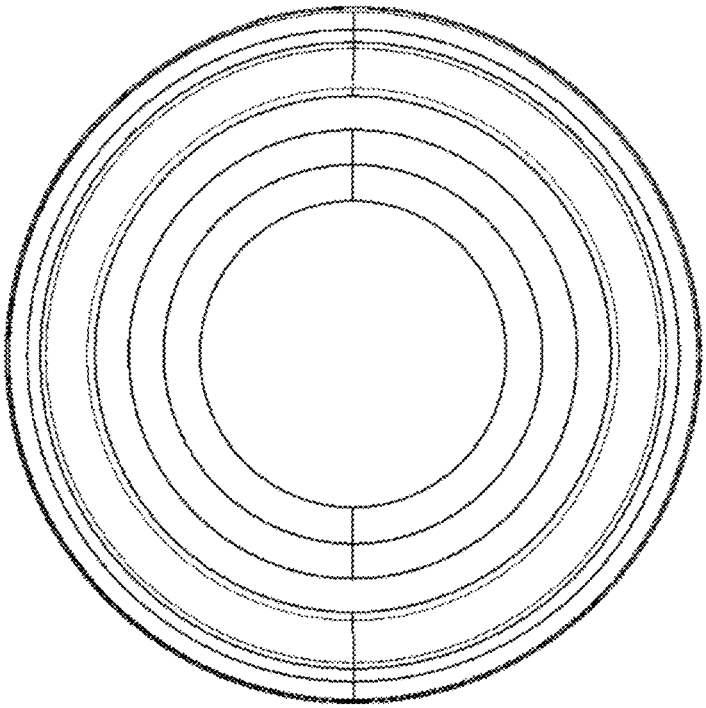
FIG. 10 depicts a top view of a container body 110, according to an embodiment.

FIG. 10 depicts a top view of a container body 110, according to an embodiment.

Figure 11:
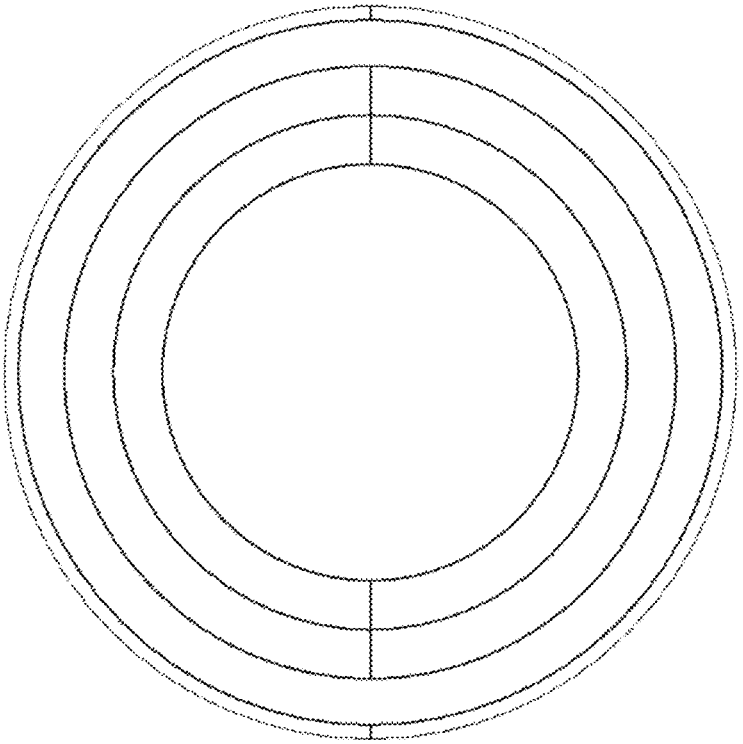
FIG. 11 depicts a bottom view of a container body 110, according to an embodiment.

FIG. 11 depicts a bottom view of a container body 110, according to an embodiment.

Figure 12:
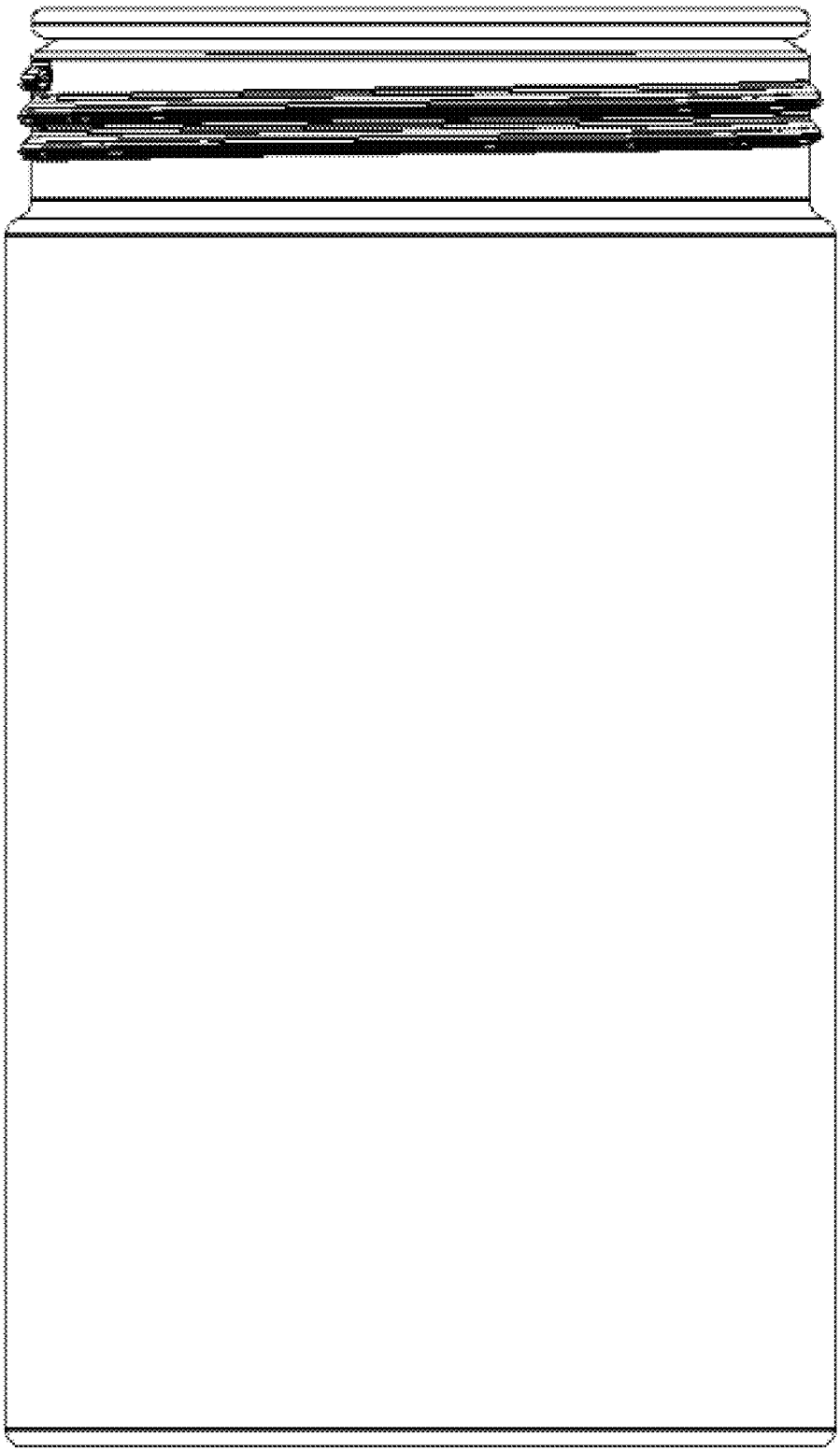
FIG. 12 depicts a side view of a container body 110, according to an embodiment.

FIG. 12 depicts a side view of a container body 110, according to an embodiment.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A fluid container comprising:

a container lid formed of a unitary piece of metal with a continuous metal inner diameter;

a container body formed of a unitary piece of metal configured to hold fluid within a chamber, the container body including a continuous metal outer diameter, the container body being configured to be coupled to the container lid, a rolled lip positioned on a proximal end of the container body, the rolled lip being outwardly turning, the rolled lip being substantially circular in shape;

mating threads configured to receive beveled threads on the container lid, wherein the beveled threads are configured to be screwed into the mating threads, the mating threads having sidewalls of a first thickness;

a groove with a sloped sidewall having a first tangential angle to the rolled lip to supply a first contact point with the rolled lip and an indentation having a second tangential angle to the rolled lip to supply a second contact point with the rolled lip, wherein the sloped sidewall directly contacts the rolled lip at the first contact point between the continuous metal inner diameter of the container lid and the continuous metal outer diameter of the container body and the indentation directly contact the rolled lip at the second contact point between the continuous metal inner diameter of the container lid and the continuous metal outer diameter of the container body, an inner diameter of the groove having a minimum inner diameter of the continuous metal inner diameter of the container lid, the first tangential angle and the second tangential angle increase a diameter of the continuous metal inner diameter of the container lid, wherein the rolled lip has sidewalls of a second thickness, the first thickness being greater than the second thickness;

an integrated valve formed of a first array of micron-sized holes positioned through the container lid, wherein the first array of micron-sized holes extends through the container lid and the micro-sized holes are smaller than 0.001 millimeter, the first array of micron-sized holes being configured to create a surface tension to restrict the flow of fluid across the integrated valve, wherein the surface tension formed by the first array of micron-sized holes is configured to be overcome by a suction force, the suction force being in a direction from the container body towards the integrated valve, the suction force being generated outside of the chamber;

a depression positioned within the container lid.

2. The fluid container of claim 1, further comprising:

an air intake valve formed of a second array of micron-sized holes being positioned within the depression, wherein the second array of micron-sized holes extends through the container lid.

3. The fluid container of claim 2, wherein the integrated valve and air intake valve are positioned one hundred eighty degrees apart from each other on the container lid.

4. The fluid container of claim 2, wherein the integrated valve is vertically offset from the air intake valve.

5. The fluid container of claim 2, wherein the integrated valve forms a first geometric shape and the air intake valve forms a second geometric shape.

6. The fluid container of claim 2, wherein a surface area of the first array is greater than that of the second array.

7. The fluid container of claim 2, wherein the lid is configured to control the surface tension with the fluid in the container, and the air intake valve is configured not allow a vacuum to be formed.

* * * * *